US008019242B2

(12) United States Patent
Kitagawa et al.

(10) Patent No.: US 8,019,242 B2
(45) Date of Patent: Sep. 13, 2011

(54) IMAGE FORMING APPARATUS AND IMAGE FORMING METHOD FOR SUPPRESSING FLUCTUATION OF FORMED IMAGES

(75) Inventors: Takashi Kitagawa, Nara (JP); Katsuhiro Nagayama, Nara (JP); Masayuki Otsuka, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 487 days.

(21) Appl. No.: 12/187,168

(22) Filed: Aug. 6, 2008

(65) Prior Publication Data

US 2009/0041484 A1 Feb. 12, 2009

(30) Foreign Application Priority Data

Aug. 9, 2007 (JP) ..... P2007-208521

(51) Int. Cl.
*G03G 15/00* (2006.01)

(52) U.S. Cl. ..... 399/43; 399/81; 358/406; 358/504

(58) Field of Classification Search ..... 399/43, 399/81; 358/406, 504
See application file for complete search history.

(56) References Cited

FOREIGN PATENT DOCUMENTS

| | | | |
|---|---|---|---|
| JP | 10-329316 | A | 12/1998 |
| JP | 2003-91224 | A | 3/2003 |
| JP | 2005-119058 | A | 5/2005 |
| JP | 2005-122341 | A | 5/2005 |
| JP | 2005-352379 | A | 12/2005 |
| JP | 2006-220959 | A | 8/2006 |
| JP | 2006-330686 | A | 12/2006 |
| JP | 2007-193278 | A | 8/2007 |

*Primary Examiner* — David M Gray
*Assistant Examiner* — G. M. Hyder
(74) *Attorney, Agent, or Firm* — Birch, Stewart, Kolasch & Birch, LLP

(57) ABSTRACT

An image forming apparatus and an image forming method capable of executing process control at appropriate timing are provided. A control section of an image forming apparatus carries out control for determining execution time of process control and executing the process control. The control section includes a counting section, a determining section and a process control management section. The counting section counts a number of printed sheets. The determining section determines on what time process control is to be executed form the counted number of printed sheets for each time zone. The process control management section manages the process control executed at an image forming section with the whole of the image forming apparatus.

11 Claims, 9 Drawing Sheets

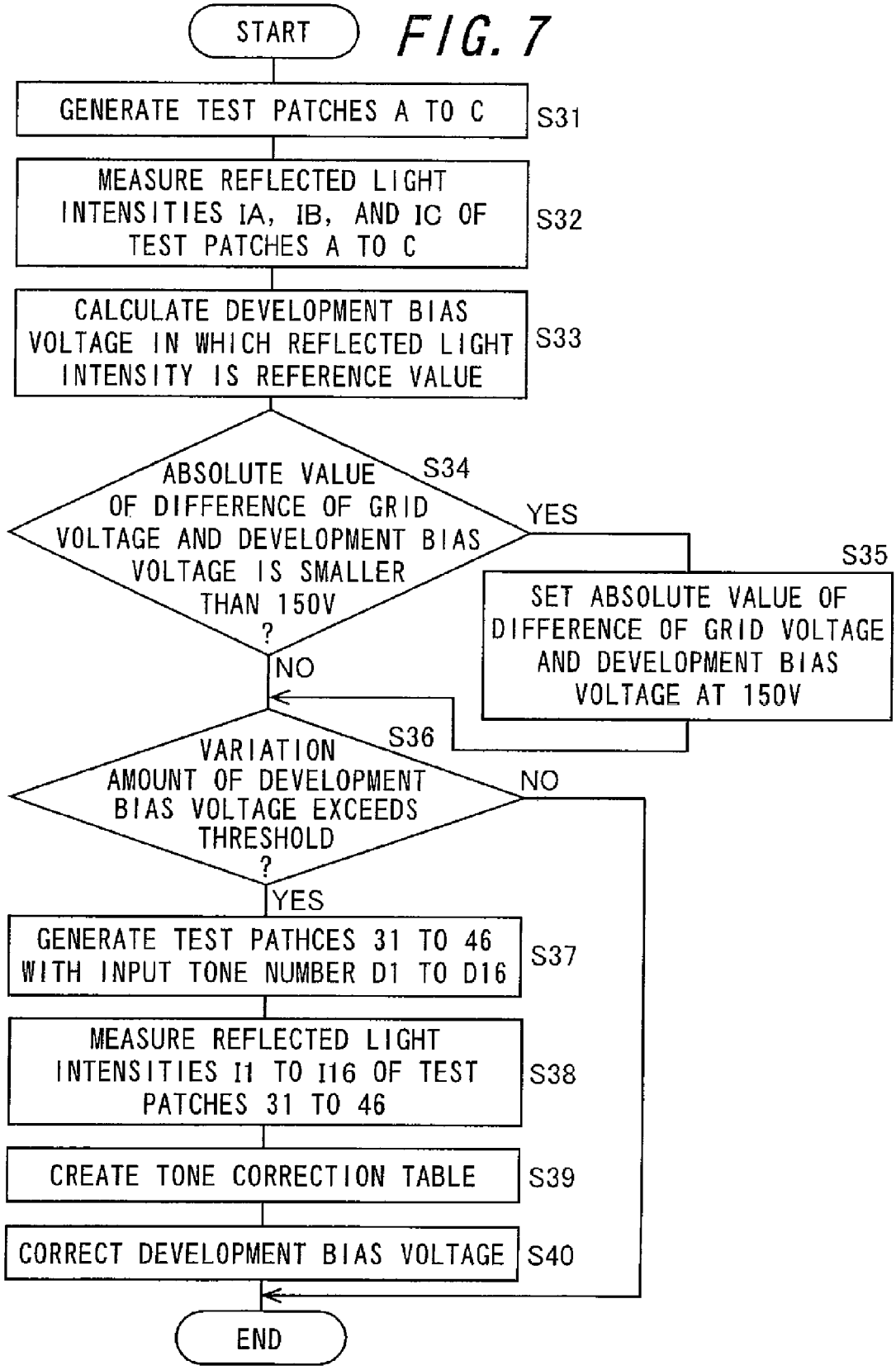
START
FIG. 7
GENERATE TEST PATCHES A TO C
S31
MEASURE REFLECTED LIGHT INTENSITIES IA, IB, AND IC OF TEST PATCHES A TO C
S32
CALCULATE DEVELOPMENT BIAS VOLTAGE IN WHICH REFLECTED LIGHT INTENSITY IS REFERENCE VALUE
S33
ABSOLUTE VALUE OF DIFFERENCE OF GRID VOLTAGE AND DEVELOPMENT BIAS VOLTAGE IS SMALLER THAN 150V ?
S34
YES
S35
SET ABSOLUTE VALUE OF DIFFERENCE OF GRID VOLTAGE AND DEVELOPMENT BIAS VOLTAGE AT 150V
NO
VARIATION AMOUNT OF DEVELOPMENT BIAS VOLTAGE EXCEEDS THRESHOLD ?
S36
NO
YES
GENERATE TEST PATHCES 31 TO 46 WITH INPUT TONE NUMBER D1 TO D16
S37
MEASURE REFLECTED LIGHT INTENSITIES I1 TO I16 OF TEST PATCHES 31 TO 46
S38
CREATE TONE CORRECTION TABLE
S39
CORRECT DEVELOPMENT BIAS VOLTAGE
S40
END

IMAGE FORMING APPARATUS AND IMAGE FORMING METHOD FOR SUPPRESSING FLUCTUATION OF FORMED IMAGES

CROSS-REFERENCE TO RELATED APPLICATION

This application claims priority to Japanese Patent Application No. 2007-208521, which was filed on Aug. 9, 2007, the contents of which are incorporated herein by reference in its entirety.

BACKGROUND OF THE INVENTION

1. Field of the Invention

The present invention relates to an image forming apparatus and an image forming method.

2. Description of the Related Art

An image forming apparatus such as a copying machine comprises a photoreceptor drum, a charging device for charging the photoreceptor drum uniformly, an exposing device for exposing the photoreceptor drum to form an electrostatic latent image, a developing device for developing the electrostatic latent image, or the like. These components or a developer contained in the developing device undergo changes in characteristics with changes in the environment such as temperature and humidity, and changes in characteristics with time. The state of images formed by charging, exposing, and developing the photoreceptor drum fluctuates with the electric changes in characteristics. There has been known a technique of changing conditions of image formation at predetermined timing to suppress the fluctuation of formed images, which is so-called process control (refer to Japanese Unexamined Patent Publications JP-A 2003-91224 and JP-A 2005-352379).

The process control is normally executed in such a manner that an image of a test pattern is actually formed, a density of the formed image is measured, and conditions of image formation are changed to eliminate a difference in density between the measurement value and an ideal value. In addition, since the image forming apparatus in question can not be used while executing the process control, a user of the image forming apparatus may be forced to have inconvenience.

When the timing of executing the process control is too late, the state of the image formation is unstable, and when the timing of executing the process control is too early, a toner is consumed wastefully or job efficiency is lowered wastefully. Accordingly, it is important that the process control is executed at appropriate timing.

In recent years, with further colorization in image forming apparatuses, an image forming apparatus has a plurality of image forming sections. The requirement to printed images (print quality) is so high that the process control is executed at the time of turning the power on, or for each predetermined number of printed sheets, however, in view of the cost, the process control consumes more than a little of toner, and therefore the execution frequency thereof is desired to be reduced as much as possible.

In the JP-A 2003-91224, the timing of executing process control is determined based on a ratio of the number of sheets of monochrome print jobs to the number of sheets of color print jobs, so that the process control is executed at appropriate timing.

In the JP-A 2005-352379, in order to make the timing of executing process control appropriate, an area coverage of 3 to 30% is determined as text printing, and the number of sheets of print jobs to execute process control is switched between text printing and color printing.

However, a technique disclosed in the JP-A 2003-91224 is directed to obtaining a ratio of monochrome printing to color printing in an interval of predetermined number of sheets, and executing no process control for color printing when the color printing is few. Accordingly, the process control is executed for each predetermined number of sheets.

Further, the technique disclosed in the JP-A 2005-352379 is directed to differentiating conditions under which the process control is executed between text data and image data. However, also in this case, the process control is executed for each predetermined number of sheets.

As described above, since the timing of executing process control relates to the toner consumption, the job efficiency, and the print quality, it is desired to further optimize the timing.

SUMMARY OF THE INVENTION

In view of the above described circumstance, an object of the invention is to provide an image forming apparatus and an image forming method capable of executing process control at appropriate timing.

The invention provides an image forming apparatus comprising an image forming section having an image carrier, a charging section for charging the image carrier uniformly, an exposure section for exposing the image carrier to form an electrostatic latent image, and a developing section for attaching a toner to the electrostatic latent image to develop the electrostatic latent image, the image forming section undergoing process control, the image forming apparatus comprising:

a counting section for counting a number of printed sheets which have been printed with an image formed by the image forming section in a predetermined time zone;

a determining section for determining execution time of the process control based on the number of printed sheets counted by the counting section; and a process control management section for managing an execution of the process control in the image forming section.

According to the invention, an image forming apparatus comprises an image forming section having an image carrier, a charging section for charging the image carrier uniformly, an exposure section for exposing the image carrier to form an electrostatic latent image, and a developing section for attaching a toner to the electrostatic latent image to develop the electrostatic latent image, the image forming section undergoing process control, and comprises: a counting section for counting a number of printed sheets which have been printed with an image formed by the image forming section in a predetermined time zone; a determining section for determining execution time of the process control based on the number of printed sheets counted by the counting section; and a process control management section for managing an execution of the process control in the image forming section.

The execution time of the process control can be determined based on the number of printed sheets which have been printed with the image formed by the image forming section in the predetermined time zone, in other words, using result of the image forming section for each time zone, resulting that it is possible to execute the process control at appropriate timing and secure an optimum printed image at all times.

Furthermore, in the invention, it is preferable that the image forming apparatus further comprises a judging section for judging whether the image formed by the image forming section is a color image or a monochrome image, wherein the counting section counts, in the predetermined time zone, a number of printed sheets which have been printed with the color image formed by the image forming section, and a number of printed sheets which have been printed with the monochrome image formed by the image forming section, and the determining section determines execution time of the process control of a color image forming section for forming the color image based on the number of printed sheets for the color image counted by the counting section, and determines execution time of the process control of a monochrome image forming section for forming the monochrome image based on the number of printed sheets for the monochrome image counted by the counting section.

According to the invention, the timing of executing the process control is adjusted in accordance with using result of the color image formation and the monochrome image formation, resulting that it possible to secure an optimum printed image at all times and shorten the time that a user has to wait unnecessarily.

Furthermore, in the invention, it is preferable that the image forming apparatus further comprises a histogram generating section for generating a time zone-basis histogram of the number of printed sheets counted by the counting section, wherein the determining section determines the execution time of the process control based on the time zone-basis histogram.

According to the invention, the execution time of the process control is determined using the time zone-basis histogram, resulting that it is possible to execute the process control at more appropriate timing and secure an optimum printed image at all times.

Furthermore, in the invention, it is preferable that the image forming apparatus is operable in a copy mode, a printer mode, and a facsimile mode, the counting section counts the number of printed sheets which have been printed with the image formed by the image forming section for each of the modes, and the histogram generating section generates, for each of the modes, the time zone-basis histogram of the number of printed sheets counted by the counting section.

According to the invention, the execution time of the process control is determined depending on a requirement to a printed image quality in each of the modes, resulting that it is possible to execute the process control at more appropriate timing and secure an optimum printed image at all times.

Furthermore, in the invention, it is preferable that the determining section determines the execution time of the process control based on the time zone-basis histogram of a previous operating day.

According to the invention, the process control is executed at the timing appropriate to the recent using result of the image forming apparatus, resulting that it is possible to secure an optimum printed image at all times.

Furthermore, in the invention, it is preferable that the determining section determines the execution time of the process control based on an average time zone-basis histogram of a previous operating week.

According to the invention, the process control is executed at the timing appropriate to the recent using result of the image forming apparatus, resulting that it is possible to secure an optimum printed image at all times.

In the invention, it is preferable that the determining section determines a time which is between one and two hours before a start time of a time zone showing a maximum number of printed sheets as the execution time of the process control.

According to the invention, the process control is executed before the time zone in which the image forming apparatus is used most frequently, resulting that it is possible to secure an optimum printed image at all times.

Furthermore, in the invention, it is preferable that, when the execution time of the process control and a generation time of a print job signal overlap, the process control management section gives a priority to the execution of the process control.

According to the invention, the priority is given to the execution of the process control, resulting that it is possible to secure an optimum printed image at all times.

Furthermore, in the invention, it is preferable that, when the execution time of the process control and the generation time of the print job signal overlap, the process control management section performs a screen display to notify a user of giving the priority to the execution of the process control.

According to the invention, the reason of a wait time can be provided to the user.

Furthermore, in the invention, it is preferable that, when the execution time of the process control and the generation time of the print job signal overlap, the process control management section is configured so that the user can manually switch to give the priority to the print job.

According to the invention, it is also possible to switch to give the priority to the print job depending on a requirement from the user.

Furthermore, in the invention, it is preferable that the process control management section manages the execution of the process control based on information of the image formed by the image forming section.

According to the invention, it is possible to prevent a toner from being consumed wastefully or prevent job efficiency from being lowered wastefully.

Furthermore, the invention provides an image forming method comprising process-controlling an image forming section having an image carrier, a charging section for charging the image carrier uniformly, an exposure section for exposing the image carrier to form an electrostatic latent image, and a developing section for attaching a toner to the electrostatic latent image to develop the electrostatic latent image, the method comprising:

a counting step of counting a number of printed sheets of an image formed by the image forming section in a predetermined time zone;

a determining step of determining execution time of the process control based on the number of printed sheets counted at the counting step; and a process management step of managing an execution of the process control of the image forming section.

According to the invention, an image forming method comprises process-controlling an image forming section having an image carrier, a charging section for charging the image carrier uniformly, an exposure section for exposing the image carrier to form an electrostatic latent image, and a developing section for attaching a toner to the electrostatic latent image to develop the electrostatic latent image, and comprises: a counting step of counting a number of printed sheets of an image formed by the image forming section in a predetermined time zone; a determining step of determining execution time of the process control based on the number of printed sheets counted at the counting step; and a process management step of managing an execution of the process control of the image forming section.

The execution time of the process control can be determined based on the number of printed sheets which have been printed with the image formed by the image forming section in the predetermined time zone, in other words, using result of the image forming section for each time zone, it is possible to execute the process control at appropriate timing and secure an optimum printed image at all times.

BRIEF DESCRIPTION OF THE DRAWINGS

Other and further objects, features, and advantages of the invention will be more explicit from the following detailed description taken with reference to the drawings wherein:

FIG. 7 is a flowchart illustrating the contents for executing process control in the image forming apparatus;

DETAILED DESCRIPTION OF THE INVENTION

Figure 1:
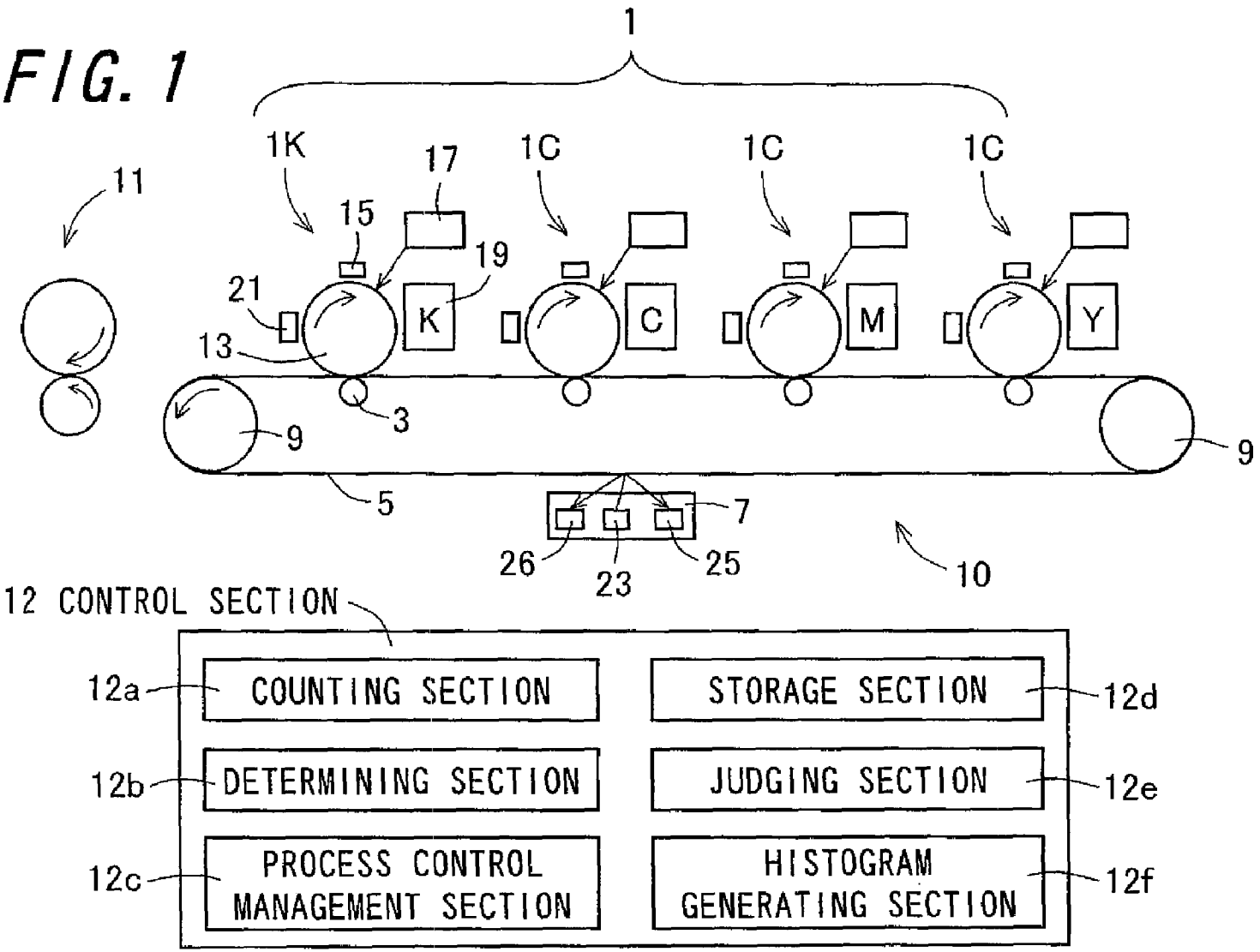
FIG. 1 is a schematic view illustrating the configuration of a main part of an image forming apparatus according to an embodiment of the invention.

Now referring to the drawings, preferred embodiments of the invention are described below.

An embodiment of the invention will be described below. Figures and the contents described below are just exemplary and the scope of the invention will not be limited thereto.

FIG. 1 is a schematic view illustrating the configuration of a main part of an image forming apparatus 10 according to an embodiment of the invention. The image forming apparatus 10 of the present embodiment includes a copying machine, a multi-function peripheral, a laser printer, a facsimile, and the like, that perform image formation by electrophotography.

The image forming apparatus of the embodiment includes image forming sections 1 for yellow (Y), magenta (M), cyan (C), and black (K), transfer rollers 3 provided for each of the image forming sections 1, a transfer belt 5 provided between the image forming sections 1 and the transfer rollers 3, a density measurement unit 7 provided close to the transfer belt 5, a belt driving roller 9 for driving the transfer belt 5, a fixing device 11, and a control section 12 for controlling them.

The image forming section 1 for black is used for both of monochrome printing and color printing, and the image forming sections 1 for yellow, magenta, and cyan are used for the color printing. Hereinafter, the image forming section 1 for black is referred to as "a black image forming section 1K", and the image forming sections 1 for yellow, magenta, and cyan are referred to as "color image forming sections 1C". In the color printing, both of the color image forming sections 1C and the black image forming section 1K are used, but in the monochrome printing, the transfer belt 5 retreats so as to have a gap between the transfer belt 5 and the color image forming sections 1C, and only the black image forming section 1K is used.

The image forming section 1 includes a photoreceptor drum 13, a charging device 15, an exposure device 17, a developing device 19, and a cleaning device 21.

The charging device 15 is provided so as to charge the photoreceptor drum 13 uniformly. The exposure device 17 has a laser diode, and is provided such that the photoreceptor drum 13 is irradiated with laser light and electric charges in a part to which a toner is to be attached are removed to thereby form an electrostatic latent image. The developing device 19 contains a toner for yellow, magenta, cyan, or black, and is provided such that the toner is attached to the electrostatic latent image using a developing roller, and thereby the electrostatic latent image is developed to form a toner pattern on the photoreceptor drum 13.

The toner pattern on the photoreceptor drum 13 is transferred onto a recording paper conveyed by the transfer belt 5 or onto the transfer belt 5 itself, by the transfer roller 3. The cleaning device 21 is provided so as to remove the toner remained on the photoreceptor drum 13 after the transfer. The cleaning device 21 may be omitted when not necessary. The toner pattern transferred onto the recording paper is heated and fused to be fixed in the fixing device 11. In addition, the toner attached to the transfer belt 5 and electric charges reserved on the transfer belt 5 are removed by a cleaning member or an electric-charge removing member, which are not shown.

Here, description will be made with respect to a case where the toner pattern on the photoreceptor drum 13 is directly transferred onto the recording paper, which is basically applicable to an embodiment in which the toner pattern on the photoreceptor drum 13 is transferred onto an intermediate transfer belt and the toner pattern thereon is transferred to the recording paper.

The density measurement unit 7 includes a light emitting element 23 for irradiating light toward the transfer belt 5, a regular reflection light receiving element 25 for receiving light regularly reflected by the toner pattern transferred onto the transfer belt 5 and outputting a voltage depending on a quantity of the received light, and an irregular reflection light receiving element 26 for receiving light irregularly reflected by the toner pattern and outputting a voltage depending on a quantity of the received light.

Here, description will be made with respect to a case where the toner pattern on the transfer belt 5 is irradiated with light, which is basically applicable to an embodiment in which the toner pattern on the photoreceptor drum 13 is irradiated with light.

<Method for Determining Execution Time of Process Control>

Here, first to third embodiments of a method for determining execution time of process control as the characteristic of the invention will be described. A control section 12 determines execution time of process control and carries out control for executing the process control.

First Embodiment

In a first embodiment of the invention, the control section 12 includes a counting section 12*a*, a determining section 12*b*, and a process control management section 12*c*. The counting section 12*a* counts the number of printed sheets. The determining section 12*b* determines on what time process control is to be executed from the counted number of printed sheets. The process control management section 12*c* manages the process control executed at an image forming section 1 with the whole of the image forming apparatus. Based on the number of printed sheets of an image formed by the image forming section 1 in a predetermined time zone, in other words, using result of the image forming section 1 for each time zone, it is possible to determine the execution time of the process control, and therefore the process control can be executed at appropriate timing and an optimum printed image can be secured at all times.

Figure 2:
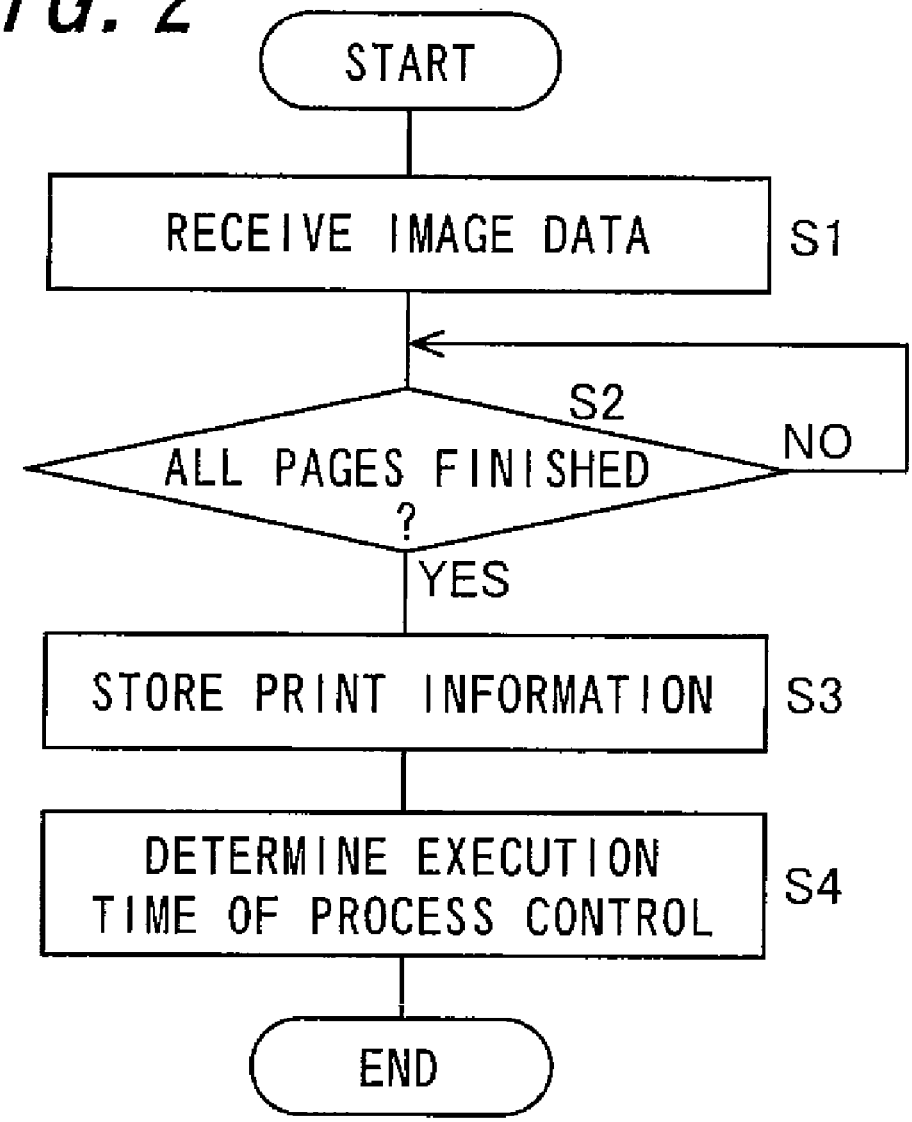
FIG. 2 is a flowchart illustrating a first embodiment of the invention.

FIG. 2 is a flowchart illustrating the first embodiment of the invention.

The control section 12 receives image data (step S1), and determines, for each sheet of printing, whether or not printing for all pages of the image data is finished (step S2). When the printing for all the pages is not finished (NO), the control section 12 waits complete finishing of the printing for all the pages. When the printing for all the pages is finished (YES), the procedure proceeds to step S3.

The counting section 12*a* counts the number of printed sheets and stores print information (the number of printed sheets and print time) of the image in a storage section 12*d* included in the controls section 12 (step S3). Subsequently, the determining section 12*b* calculates the number of printed sheets for each time zone from the print information (the number of printed sheets and print time), and based on which, the determining section 12*b* determines execution time of process control (step S4).

Second Embodiment

In a second embodiment of the invention, the control section 12 further includes a judging section 12*e*. The judging section 12*e* judges whether or not image data includes color information. The timing of executing process control is adjusted in response to using result of color image formation and monochrome image formation, thus making it possible to secure an optimum printed image at all times and shorten the time that a user has to wait unnecessarily.

Figure 3:
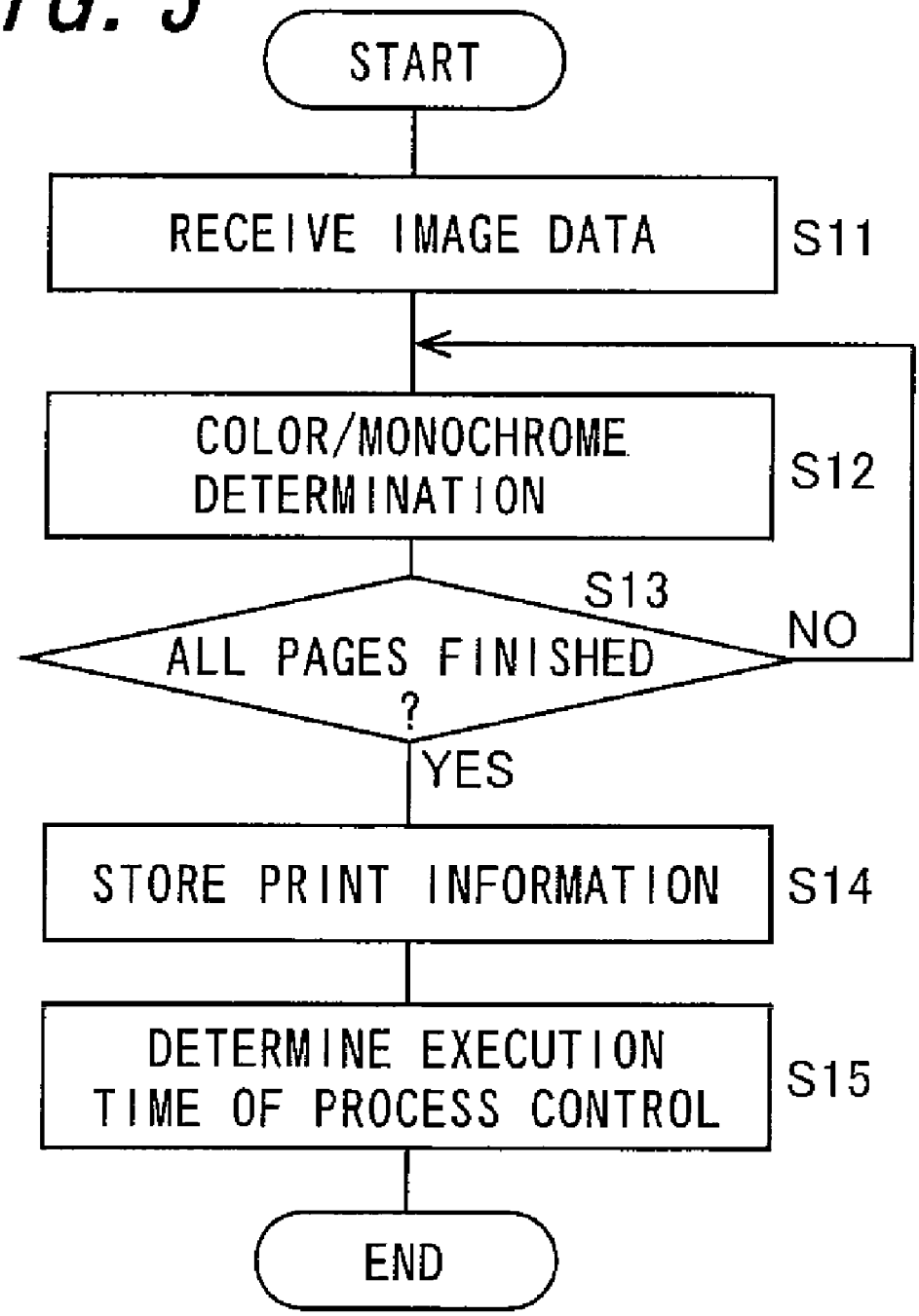
FIG. 3 is a flowchart illustrating a second embodiment of the invention.

FIG. 3 is a flowchart illustrating the second embodiment of the invention.

The control section 12 receives image data (step S11) and the judging section 12*e* judges, every time image data is received, whether the received image is a color image or a monochrome image (step S12).

Image data read by a CCD (charge couple device) color image sensor is dot sequential data in which cyan, magenta, and yellow are arranged in this order for each pixel. When a value of pixel data of each cyan, magenta, and yellow for constituting one pixel is not less than a predetermined value, the judging section 12*e* determines that the received image is a color image, and when the pixel data value is not more than the predetermined value, the judging section 12*e* determines that the received image is a monochrome image.

The control section 12 determines, for each sheet of printing, whether or not printing for all pages of the image data is finished (step S13). When the printing for all the pages is not finished (NO), the procedure goes back to step S12, and the control section 12 carries out judgment for subsequently received image data. When the printing for all the pages is finished (YES), the procedure proceeds to step S14.

The counting section 12*a* counts the number of printed sheets and stores print information (the number of printed sheets and print time) of a color image and a monochrome image in a storage section 12*d* included in the controls section 12 (step S14). Subsequently, the determining section 12*b* calculates the number of printed sheets for each time zone from the print information (the number of printed sheets and print time), and based on which, the determining section 12*b* determines execution time of process control (step S15).

Third Embodiment

In a third embodiment of the invention, the control section 12 further includes a histogram generating section 12*f*. The histogram generating section 12*f* generates a histogram of the number of printed sheet for each time zone from print information (the number of printed sheets and print time). Execution time of process control is determined using the time zone-basis histogram, and therefore it is possible to execute the process control at more appropriate timing and secure an optimum printed image at all times.

Figure 4:
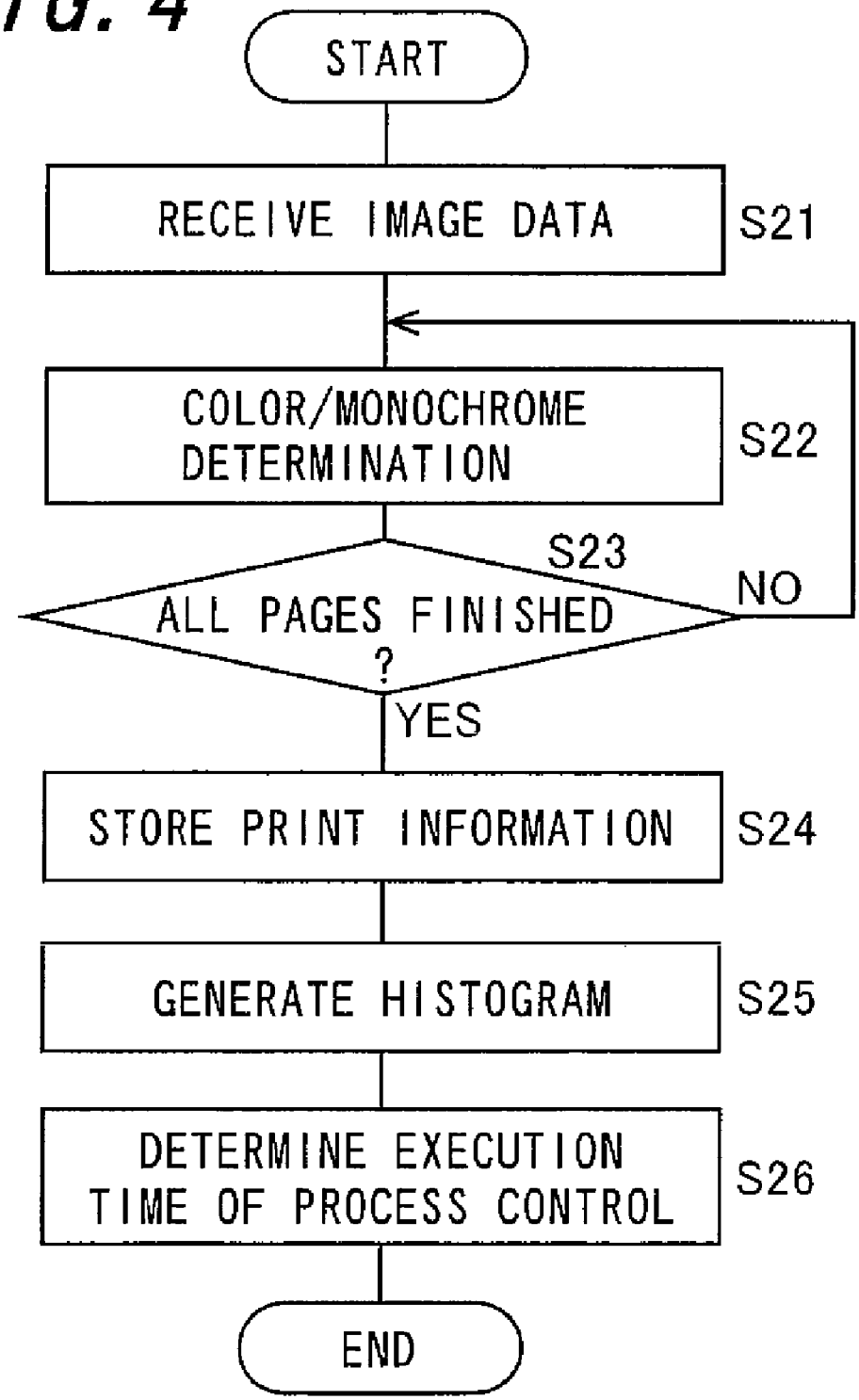
FIG. 4 is a flowchart illustrating a third embodiment of the invention.

FIG. 4 is a flowchart illustrating the third embodiment of the invention.

The control section 12 receives image data (step S21), and the judging section 12*e* judges, every time image data is received, whether the received image is a color image or a monochrome image (step S22).

Image data read by a CCD (charge couple device) color image sensor is dot sequential data in which cyan, magenta, and yellow are arranged in this order for each pixel. When a value of pixel data of each cyan, magenta, and yellow for constituting one pixel is not less than a predetermined value, the judging section 12*e* determines that the received image is a color image, and when the pixel data value is not more than the predetermined value, the judging section 12*e* determines that the received image is a monochrome image.

The control section 12 determines, for every each sheet of printing, whether or not printing for all pages of the image data is finished is judged (step S23). When the printing for all the pages is not finished (NO), the procedure goes back to step S22, and the control section 12 carries out judgment of subsequently received image data. When the printing for all the pages is finished (YES), the procedure proceeds to step S24.

The counting section 12*a* counts the number of printed sheets, and stores print information (the number of printed sheets and print time) of a color image and a monochrome image in a storage section 12*d* included in the controls section 12 (step S24). Based on the stored print information (the number of printed sheets and print time), the histogram generating section 12*f* calculates the number of printed sheets for each time zone, and generates a histogram showing the number of printed sheets for each predetermined time zone (step S25). Subsequently, based on the histogram generated from the print information (the number of printed sheets and print time), the determining section 12*b* determines execution time of process control (step S26).

Figure 5:
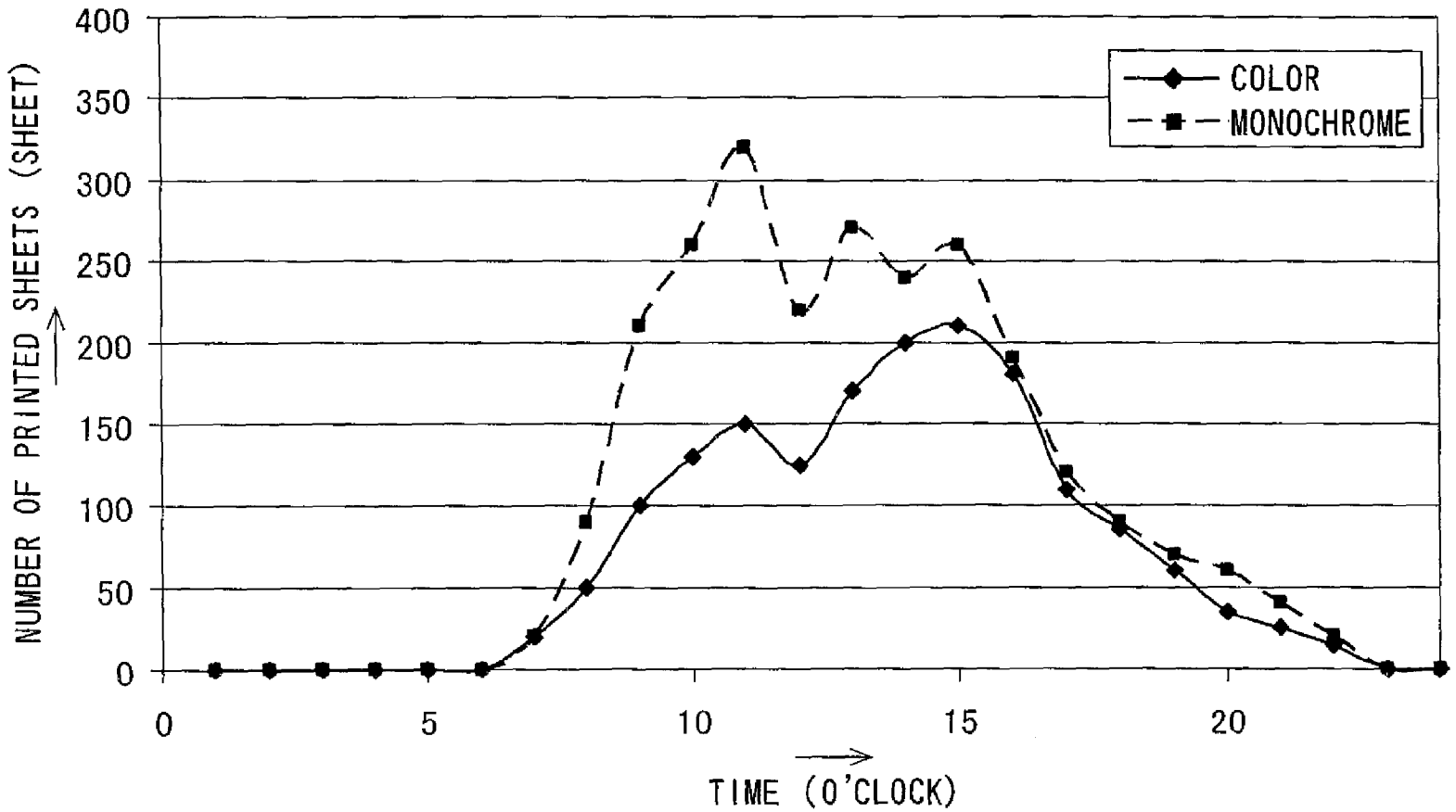
FIG. 5 is a histogram showing a relation of the number of printed sheets and time on a previous operating day.

FIG. 5 is a histogram showing a relation of the number of printed sheets and time on a previous operating day. The abscissa shows time (o'clock) and the ordinate shows the number of printed sheets (sheet), which indicate the number of printed sheets for every hour. In the image forming apparatus 10 capable of carrying out color and monochrome image formations, when plotting the number of printed sheet for each time zone of a day in time series, the pattern in the number of printed sheets can be different between color and monochrome printings.

Specifically, as shown in FIG. 5, while a maximum peak appears at around 15:00 in the color printing, a maximum peak appears at around 11:00 in the monochrome printing. Accordingly, in a time zone in which a maximum peak appears, the apparatus is used quite frequently, and when process control is executed in this time zone, a wait time is caused for a user. Then, by executing optimum process control depending on each of the print modes without executing process control for the color and the monochrome simultaneously, a user-friendly image forming apparatus can be provided.

For example, a case that an image forming apparatus is used in an office is assumed. It is not that a same document is printed every day in the image forming apparatus, but a meeting or a conference is regularly held, thus it is considered that a difference of color and monochrome print frequency or peak time necessarily occurs. Then, in the example shown in FIG. 5, timer setting is carried out to manage so that the process control for the color is executed at around 13:00, which is two hours before the time zone in which the color printing peaks, and the process control for the monochrome is executed at around 9:00, which is two hours before the time zone in which the monochrome printing peaks. The reason for setting so as to be two hours before is that the number of printed sheets is considered to be rapidly increased about two hours before the peak hours.

The time which is between one and two hours before the start time of peak hours showing the maximum number of printed sheets is determined as execution time of process control, and thereby the process control is executed before the time zone in which the image forming apparatus is used most frequently, thus it is possible to secure an optimum printed image at all times.

Although printing states of the color and the monochrome are not considered to be same due to use purposes and an installed environment of the image forming apparatus, the printing trend is predictably same as that of a previous operating day unless the place of the apparatus itself is moved, and therefore, by executing this control, it is possible to obtain a clear printed image at all times. The process control is executed at the timing appropriate to the recent using result of the image forming apparatus, and thereby it is possible to secure an optimum printed image at all times.

Figure 6:
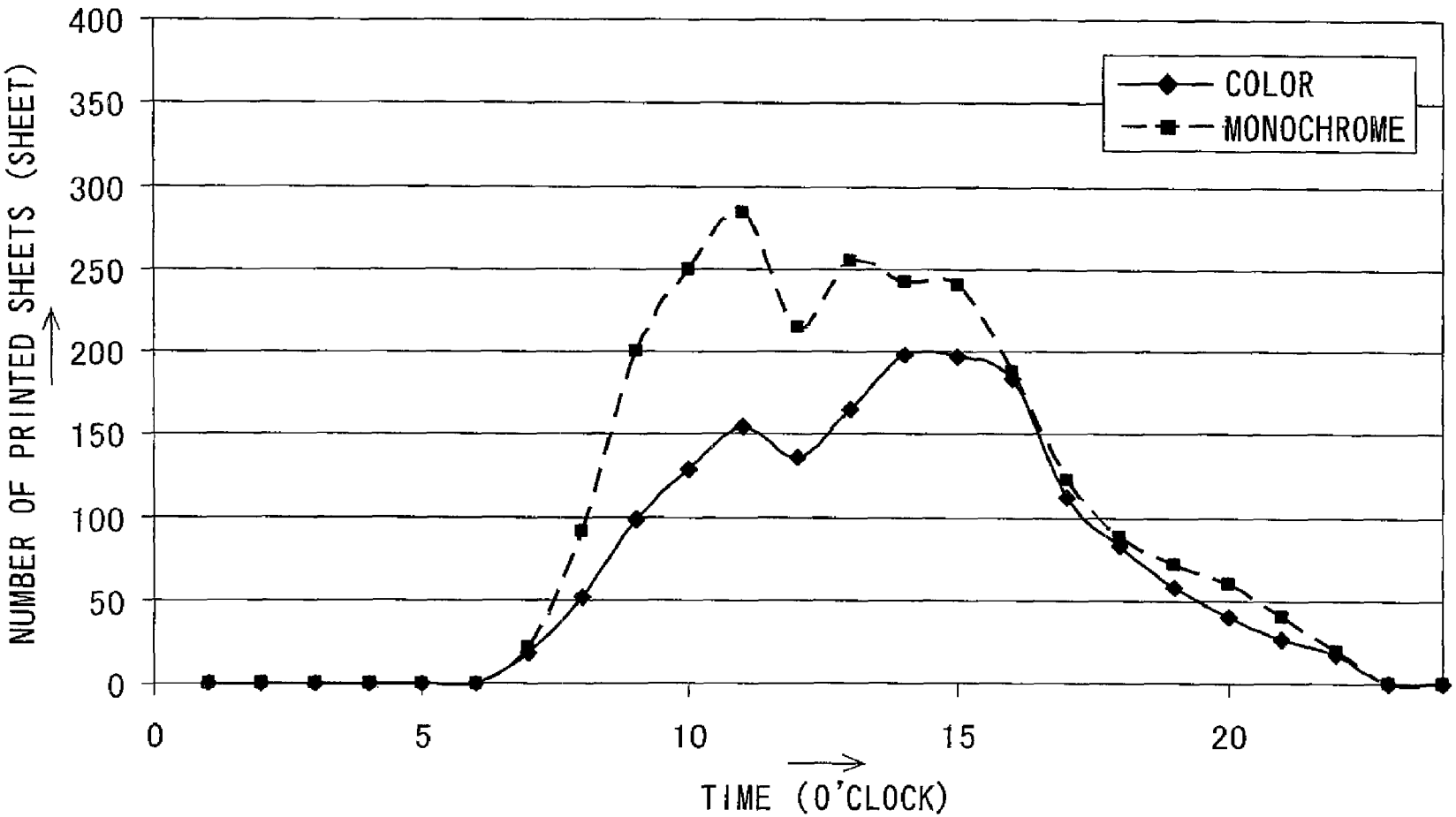
FIG. 6 is a histogram showing a relation of the average number of printed sheets and time in a previous operating week.

FIG. 6 is a histogram showing a relation of the average number of printed sheets and time in a previous operating week. The abscissa shows time (o'clock) and the ordinate shows the number of printed sheets (sheet), which indicate the number of printed sheets for every hour. The number of printed sheets is the average number of sheets for a week. In the image forming apparatus 10 capable of carrying out color and monochrome image formations, when plotting the average number of printed sheets for each time zone of the previous operating week in time series, the pattern in the number of printed sheets can be different between the color and the monochrome.

Specifically, as shown in FIG. 6, while a maximum peak appears at around 14:00 in the color printing, a maximum peak appears at around 11:00 in the monochrome printing. Accordingly, in a time zone in which a maximum peak appears, the apparatus is used quite frequently, and when process control is executed in this time zone, a wait time is caused for a user. Then, by executing optimum process control depending on each of the print modes without executing process control for the color and the monochrome simultaneously, a user-friendly image forming apparatus can be provided.

For example, a case that an image forming apparatus is used in an office is assumed. It is not that a same document is printed every day in the image forming apparatus, but a meeting or a conference is regularly held, thus it is considered that a difference of color and monochrome print frequency or peak time necessarily occurs. Then, in the example shown in FIG. 6, timer setting is carried out to manage so that the process control for the color is executed at around 12:00, which is two hours before the time zone in which the color printing peaks, and the process control for the monochrome is executed around 9:00, which is two hours before the time zone in which the monochrome printing peaks. The reason for setting so as to be two hours before is that the number of printed sheets is considered to be rapidly increased about two hours before the peak hours.

The time which is between one and two hours before the start time of peak hours showing the maximum number of printed sheets is determined as execution time of process control, and thereby the process control is executed before the time zone in which the image forming apparatus is used most frequently, thus it is possible to secure an optimum printed image at all times.

Although printing states of the color and the monochrome are not considered to be the same due to use purposes and an installed environment of the image forming apparatus, it is predicted that the printing trend is substantially the same as that of the previous operating day unless the place of the apparatus itself is moved, and therefore, by executing this control, it is possible to a obtain clear printed image at all times. The process control is executed at the timing appropriate to the recent using result of the image forming apparatus, and thereby it is possible to secure an optimum printed image at all times.

In the embodiment above, basically, process control is set automatically, but it is possible to switch manually when a user wants to give a priority to the printing speed temporarily. However, the quality of a printed image is slightly degraded in this case.

Further, although the description has been made based on that process control is executed once everyday, it is possible to obtain a clearer printed image by executing in combination with conventional regular process control (at the time of turning the power on, or for each predetermined number of printed sheets).

When the image forming apparatus is operable in a plurality of modes including a copy mode, a printer mode, and a facsimile mode, it is preferable that the counting section 12*a* counts the number of printed sheets which have been printed with an image formed by the image forming section 1 for each of the modes, and the histogram generating section 12*f* generates, for each of the modes, a time zone-basis histogram of the number of printed sheets, which is counted by the counting section 12*a*. Execution time of process control is determined depending on a requirement for the quality of a printed image for each of the modes, it is possible to execute the process control at more appropriate timing and secure an optimum printed image at all times. For example, since the requirement for the quality of a printed image is low in the facsimile mode compared with the copy mode and printer mode, it is preferable to control so that each of the modes has individual histogram and the frequency of executing process control in the facsimile mode is reduced. Alternatively, the histogram generating section 12*f* may not generate a histogram in the facsimile mode.

When execution time of process control and generation time of print job signal overlap, the process control management section 12*c* preferably gives a priority to the process control. Giving a priority to the process control makes it possible to secure an optimum printed image at all times. Further, it is preferable that a screen to notify a user of giving a priority to the execution of the process control is displayed. In this way, the reason of a wait time can be provided to the user. However, it is preferable that it is configured so that a user is capable of switching manually to give a priority to a print job. It is also possible to switch to give a priority to a print job depending on a requirement from the user.

FIG. 7 is a flowchart illustrating the contents for executing process control in the image forming apparatus 10. In execution processing of the process control, various kinds of conditions for image forming related to the image forming section 1 is adjusted by the control section 12. In the embodiment, the process control is composed of high density correction (steps S31 to S35) and tone correction (steps S37 to S40). In addition, here, the tone correction is carried out only when variation amounts in a development bias value by the high density correction exceeds a threshold, but may be carried out for every process control. Here, although description will be made with respect to a case where process control of the black image forming section 1K is executed, the same method is applicable to the color image forming sections 1C. Here, an example of methods and conditions for executing process control will be shown, but not limited thereto.

Further, it is preferable that execution of process control is managed based on information of an image formed by the image forming section 1. A toner is prevented from being consumed wastefully or job efficiency is prevented from being lowered wastefully. For example, when a monochrome printing is mainly carried out, only high density correction to secure a solid density may be carried out, and only when a color printing is mainly carried out, the tone correction to secure tone characteristics may be carried out in addition to the high density correction. Further, in the case of a text mode, only high density correction to secure a solid density may be carried out, and only in the case of a photograph mode or a halftone mode, the tone correction may be carried out in addition to the high density correction.

<High Density Correction (Steps S31 to S35)>

A method for carrying out high density correction will be described. First, toner patterns for generating test patches A to C for the high density correction are formed on the photoreceptor drum 13 by carrying out charging, exposure and development with respect to the photoreceptor drum 13, and the toner patterns are transferred onto the transfer belt 5, and thereby the test patches A to C for the high density correction are generated (step S31).

Charging of the photoreceptor drum 13 is carried out by setting a grid voltage in the charging device 15 at Vg. The value of the grid voltage Vg is a value that is set when process control is previously executed. The initial value of the grid voltage is −600V, but can be changed at step S35 below. The exposure is carried out by setting a duty ratio of a laser diode of the exposure device 17 at 100% (i.e., continuous driving). The development is carried out while changing a development bias voltage of the developing device 19. The toner patterns for the test patches A to C are formed by developing with the development bias voltages of (Vbp−50) (V), Vbp (V), and (Vbp+50) (V), respectively. Vbp denotes a value of the development bias voltage that is set when process control is previously executed. The initial value of the development bias voltage is −325V, but can be changed at step S33 below.

Figure 8A:
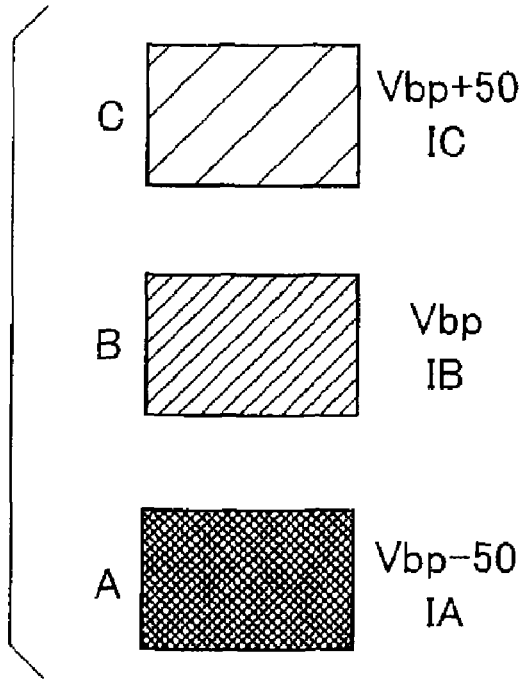
FIG. 8A is a view showing overviews of the test patches A to C.

FIG. 8A is a view showing overviews of the test patches A to C. The figure shows a state where as the development bias voltage becomes smaller (absolute value to the negative direction becomes larger), the attachment amount of the toner is increased.

Next, reflected light intensities of the test patches A to C, IA, IB, and IC, are measured (step S32). The reflected light intensities can be measured based on the magnitude of the voltage generated in the regular reflection light receiving element 25 or the irregular reflection light receiving element 26 after light is irradiated toward the test patches A to C on the transfer belt 5 from the light emitting element 23 and the light regularly reflected or irregularly reflected by the test patches A to C is received by the regular reflection light receiving element 25 or the irregular reflection light receiving element 26.

Generally, the density of the test patches A to C for the black is evaluated based on the regularly reflected light intensity, and the density of the test patches A to C for other colors is evaluated based on the irregularly reflected light intensity. As the attachment amount of the toner is increased, the quantity of the irregularly reflected light is increased and the quantity of the regularly reflected light is decreased, and therefore the magnitude of the voltage generated in the regular reflection light receiving element 25 or the irregular reflection light receiving element 26 is correlated with the density of the test patches A to C. Description will be hereinafter made with respect to a case where the reflected light intensity is regularly reflected light intensity.

Figure 8B:
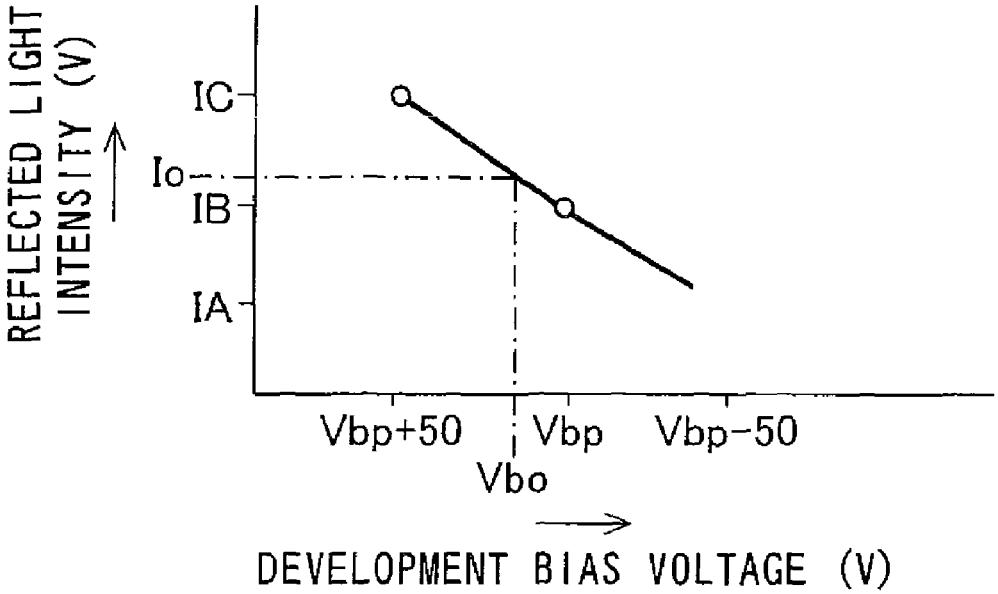
FIG. 8B is a graph showing a relation of the value of the development bias voltage when generating the test patches A to C and the reflected light intensities IA, IB, and IC.

FIG. 8B is a graph showing a relation of the value of the development bias voltage when generating the test patches A to C and the reflected light intensities IA, IB, and IC. The abscissa shows the development bias voltage (V) and the ordinate shows the reflected light intensity (V). FIG. 8B shows three measurement data corresponding to the test patches A to C, and straight line connecting adjacent two of the three measurement data.

Next, with the graph shown in FIG. 8B, the development bias voltage Vbo in which the reflected light intensity is reference value Io is calculated (step S33).

Subsequently, an absolute value of a difference between the grid voltage Vg and the development bias voltage calculated at step S33 is obtained to determine whether the absolute value thus obtained is smaller than 150V (step S34).

When the absolute value is smaller than 150V (YES), Vg is set at (Vbo−150) (V) to prevent the toner from being attached to ground (so-called "fogging") (step S35), followed by moving to step S16. When the absolute value is not less than 150V (NO), just moving to step S36.

Next, it is judged whether variation amounts (|Vbp−Vbo|) in the developing bias value by the high density correction at steps S31 to S35 exceeds a threshold of the variation amounts (ΔVbmax) (step S36). When exceeding the threshold (YES), the tone correction is carried out, and when not exceeding the threshold (NO), execution processing of process control is completed without carrying out the tone correction. The threshold of the variation amount may be different for each color, for example, a threshold of the black may be set so as to be larger than that of other colors. This is because, generally, more precise printing is required for the color printing than the monochrome printing.

<Tone Correction (Step S37 to S40)>

Next, a method for carrying out tone correction will be described. First, toner patterns for generating test patches 31 to 46 for the tone correction are formed on the photoreceptor drum 13 by carrying out charging, exposure and development with respect to the photoreceptor drum 13, and the toner patterns are transferred onto the transfer belt 5, and thereby the test patches 31 to 46 for the tone correction are generated (step S37).

Charging of the photoreceptor drum 13 is carried out by setting a grid voltage in the charging device 15 at Vg. When the value of the grid voltage Vg is changed at step S5, the charging is carried out with the value after the changing. The exposure is carried out by setting a duty ratio of a laser diode of the exposure device 17 so as to be the value corresponding to input tone numbers D1 to D16. As an example, D1 to D16 are 255, 239, 223, 207, 191, 175, 159, 143, 127, 111, 95, 79, 63, 47, 31, and 15, respectively. The laser duty ratio corresponding to the input tone number is obtained by referring to a tone correction table in which the input tone number and the laser duty ratio are associated with each other. Although the tone correction table that is created in the previous tone correction is used, a default tone correction table that is incorporated into the apparatus on shipment is used in the initial tone correction. The development is carried out with the development bias voltage Vbo calculated at step S33.

Figure 9A:
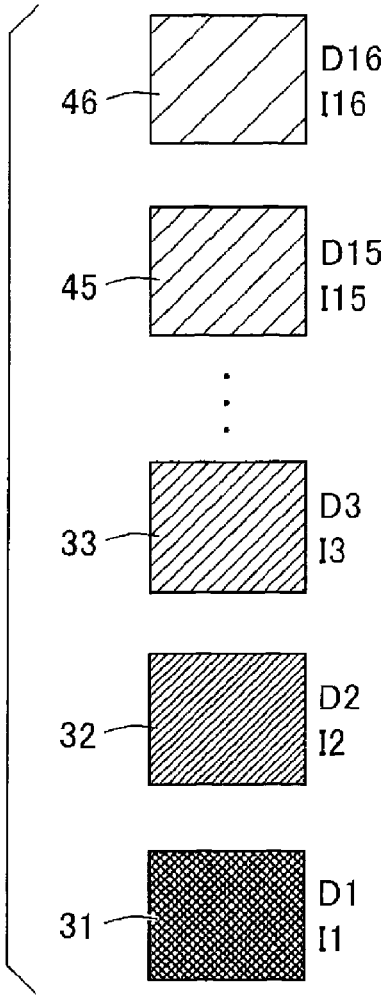
FIG. 9A is a diagram showing overviews of the test patches 31 to 46.

FIG. 9A is a diagram showing overviews of the test patches 31 to 46. The figure shows a state where as the input tone number becomes larger, the attachment amount of the toner is increased.

Next, reflected light intensities of the test patches 31 to 46, I1 to I16, are measured (step S38). The reflected light intensities I1 to I16 can be measured with the same method as that of the high density correction.

Figure 9B:
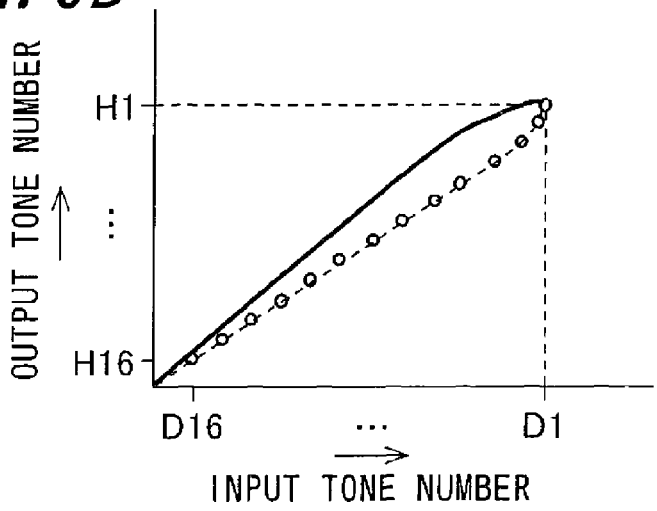
FIG. 9B is a graph showing a relation of the input tone number D1 to D16 corresponding to the test patches and the output tone number H1 to H16 obtained based on the reflected light intensities I1 to I16.

FIG. 9B is a graph showing a relation of the input tone number D1 to D16 corresponding to the test patches 31 to 46 and the output tone number H1 to H16 obtained based on the reflected light intensities I1 to I16. The abscissa shows the input tone number and the ordinate shows the output tone number. FIG. 9B shows sixteen measurement data corresponding to the test patches 31 to 46, a curve B obtained from the sixteen measurement data with a least square method or the like, and an ideal curve A showing an ideal relation of the input tone number and the output tone number.

It is ideal that the input tone number and the output tone number have the relation of the ideal curve A (thus, the tone correction table was created in the previous tone correction so that the input tone number and the output tone number have the relation of the ideal curve A), however, the relation of the input tone number and the output tone number have, for example, a relation of the curve B being shifted out of the ideal curve A, because of the environmental change, deterioration with the lapse of time, or the like. Then, the laser duty ratio is obtained for each input tone number so that the relation of the input tone number and the output tone number matches with the ideal curve A, and thereby a new tone correction table in which the input tone number and the laser duty ratio are associated with each other is created (step S39).

Next, the development bias voltage Vbo is saved as Vbp (step S40), and processing of the tone correction is completed and further execution processing of process control is completed. In the next high density correction, the test patches A to C are generated with the development bias voltage of (Vbp−50) (V), Vbp (V), and (Vbp+50) (V) (refer to step S31).

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus including an image forming section having an image carrier, a charging section for charging the image carrier uniformly, an exposure section for exposing the image carrier to form an electrostatic latent image, and a developing section for attaching a toner to the electrostatic latent image to develop the electrostatic latent image, the image forming section undergoing process control, the image forming apparatus comprising:

a counting section for keeps a cumulative count of number of printed sheets, printed with an image formed by the image forming section, which are counted in predetermined time segments, each of the time segments being obtained by dividing up a recurring time cycle;

a histogram generating section for generating a histogram of the cumulative counts corresponding to the predetermined time segments;

a determining section for determining an execution time of performing the process control, such that the execution process control is performed a predetermined time prior to a time segment which represents a peak of the latest histogram; and a process control management section for managing an execution of the process control in the image forming section.

2. The image forming apparatus of claim 1, further comprising:

a judging section for judging whether the image formed by the image forming section is a color image or a monochrome image, wherein the counting section counts within each of the predetermined time segments, a number of printed sheets which have been printed with the color image formed by the image forming section, and a number of printed sheets which have been printed with the monochrome image formed by the image forming section, and the determining section determines execution time of the process control of a color image forming section for forming the color image based on the number of printed sheets for the color image counted by the counting section, and determines execution time of the process control of a monochrome image forming section for forming the monochrome image based on the number of printed sheets for the monochrome image counted by the counting section.

3. The image forming apparatus of claim 1, wherein the image forming apparatus is operable in a copy mode, a printer mode, and a facsimile mode, the counting section counts the number of printed sheets which have been printed with the image formed by the image forming section for each of the modes, and the histogram generating section generates, for each of the modes, the histogram of the number of printed sheets counted by the counting section within each of the predetermined time segments.

4. The image forming apparatus of claim 1, wherein the determining section determines the execution time of the process control based on the generated histogram of a previous operating day.

5. The image forming apparatus of claim 1, wherein the determining section determines the execution time of the process control based on an average of the histogram of a previous operating week.

6. The image forming apparatus of claim 1, wherein the predetermined time is between one and two hours before a start time of the predetermined period of time showing the maximum number of printed sheets as the execution time of the process control.

7. The image forming apparatus of claim 1, wherein, when the execution time of the process control and a generation time of a print job signal overlap, the process control management section gives a priority to the execution of the process control.

8. The image forming apparatus of claim 7, wherein, when the execution time of the process control and the generation time of the print job signal overlap, the process control management section performs a screen display to notify a user of giving the priority to the execution of the process control.

9. The image forming apparatus of claim 7, wherein, when the execution time of the process control and the generation time of the print job signal overlap, the process control management section is configured so that the user can manually switch to give the priority to the print job.

10. The image forming apparatus of claim 1, wherein the process control management section manages the execution of the process control based on information of the image formed by the image forming section.

11. An image forming method including process-controlling an image forming section having an image carrier, a charging section for charging the image carrier uniformly, an exposure section for exposing the image carrier to form an electrostatic latent image, and a developing section for attaching a toner to the electrostatic latent image to develop the electrostatic latent image, the method comprising:

Keeping a cumulative count of a number of printed sheets of an image formed by the image forming section that are counted in predetermined time segments, each of the time segments being obtained by dividing up a recurring time cycle;

generating a histogram of the cumulative counts corresponding to the predetermined time segments;

determining an execution time of performing the process control, such that the execution process control is performed a predetermined time prior to a time segment which represents a peak of the latest histogram; and managing an execution of the process control of the image forming section.

* * * * *